US010189588B2

(12) United States Patent
Milbrandt et al.

(10) Patent No.: US 10,189,588 B2
(45) Date of Patent: Jan. 29, 2019

(54) BUNDLING ARTICLE WITH ELASTIC LOOP AND COOPERATING TAG

(71) Applicant: Bedford Industries, Inc., Worthington, MN (US)

(72) Inventors: Jay A. Milbrandt, Worthington, MN (US); Troy Lang, Fulda, MN (US); Eric Milbrath, Brewster, MN (US); David Schiller, Sioux Falls, SD (US); Trevor Wintz, Round Lake, MN (US)

(73) Assignee: Bedford Industries, Inc., Worthington, MN (US)

( * ) Notice: Subject to any disclaimer, the term of this patent is extended or adjusted under 35 U.S.C. 154(b) by 70 days.

(21) Appl. No.: 15/622,879

(22) Filed: Jun. 14, 2017

(65) Prior Publication Data

US 2018/0009556 A1 Jan. 11, 2018

Related U.S. Application Data

(60) Provisional application No. 62/359,364, filed on Jul. 7, 2016.

(51) Int. Cl.

| | |
|---|---|
| ***B65D 13/02*** | (2006.01) |
| ***B65B 13/22*** | (2006.01) |
| ***B65B 13/24*** | (2006.01) |
| ***B65B 13/02*** | (2006.01) |
| ***B65D 63/10*** | (2006.01) |

(52) U.S. Cl.

CPC ..... *B65B 13/02* (2013.01); *B65B 13/22* (2013.01); *B65B 13/24* (2013.01); *B65D 63/109* (2013.01); *B65D 63/1027* (2013.01)

(58) Field of Classification Search

CPC .. B65D 63/109; B65D 63/1027; B65B 13/02; B65B 13/22; B65B 13/24

See application file for complete search history.

(56) References Cited

U.S. PATENT DOCUMENTS

| | | | |
|---|---|---|---|
| 92,895 | A | 7/1869 | Southworth |
| 109,263 | A | 11/1870 | Southworth |
| 134,116 | A | 12/1872 | West |
| 161,145 | A | 3/1875 | Moder |
| 212,578 | A | 2/1879 | Smith |

(Continued)

FOREIGN PATENT DOCUMENTS

| | | | |
|---|---|---|---|
| EP | 1136971 | A2 | 9/2001 |
| FR | 2634574 | A1 | 1/1990 |

(Continued)

OTHER PUBLICATIONS

International Search Report and Written Opinion dated Aug. 28, 2017 for International Application No. PCT/US2017/037687.

*Primary Examiner* — Robert Sandy

(74) *Attorney, Agent, or Firm* — Mai-Tram D. Lauer; Westman, Champlin & Koehler, P.A.

(57) ABSTRACT

A bundling article includes a stretchable portion and a tag portion. The stretchable portion includes a fastening opening having a first width. The tag portion overlaps the stretchable portion at an overlap area, wherein the stretchable portion and the tag portion are bonded together at the overlap area. The tag portion includes a notch, the notch including two opposed shoulders separated by a second width. The second width is substantially equal to or greater than the first width.

11 Claims, 4 Drawing Sheets

(56) References Cited

U.S. PATENT DOCUMENTS

| | | | | |
|---|---|---|---|---|
| 224,958 | A | | 2/1880 | Rowland |
| 263,600 | A | | 8/1882 | Searing |
| 381,879 | A | | 4/1888 | Howard |
| D28,619 | S | | 5/1898 | McFadden |
| 1,221,572 | A | | 4/1917 | Morton |
| 1,397,079 | A | | 11/1921 | Cohen |
| 1,612,342 | A | | 12/1926 | Alstrand |
| 1,830,410 | A | | 11/1931 | Schaaf |
| 1,929,320 | A | | 10/1933 | Lulham |
| 1,945,932 | A | | 2/1934 | Caley |
| 2,194,220 | A | | 3/1940 | Elder |
| 2,516,292 | A | | 7/1950 | Bennett |
| 2,669,047 | A | | 2/1954 | Rieger |
| 2,937,464 | A | | 5/1960 | Marshall |
| 2,959,098 | A | | 11/1960 | Hassman |
| 3,077,683 | A | | 2/1963 | Jones |
| 3,164,250 | A | | 1/1965 | Paxton |
| 3,545,795 | A | | 12/1970 | Hertel |
| 3,602,957 | A | | 9/1971 | Chang |
| 3,621,809 | A | | 11/1971 | Paxton |
| 3,662,480 | A | | 5/1972 | Gilson |
| 3,749,622 | A | | 7/1973 | Sato |
| 3,777,378 | A | | 12/1973 | Sant'Anselmo |
| 3,783,083 | A | | 1/1974 | Jenkins |
| 3,896,524 | A | | 7/1975 | Parker |
| 3,899,074 | A | | 8/1975 | Lucas |
| 3,930,506 | A | | 1/1976 | Overend |
| 3,933,560 | A | | 1/1976 | Muttera |
| 3,955,656 | A | | 5/1976 | Kashinski |
| 4,119,449 | A | | 10/1978 | Gould et al. |
| D251,121 | S | | 2/1979 | Smith |
| 4,323,608 | A | | 4/1982 | Denny |
| 4,341,303 | A | | 7/1982 | Britt |
| 4,390,095 | A | | 6/1983 | Cunningham |
| 4,407,082 | A | | 10/1983 | Stehouwer |
| 4,433,498 | A | | 2/1984 | Bienz |
| 4,477,950 | A | | 10/1984 | Cisek |
| 4,519,178 | A | | 5/1985 | Crabb |
| 4,529,229 | A | | 7/1985 | Glibbery |
| 4,749,426 | A | | 6/1988 | Wyss |
| 5,018,286 | A | | 5/1991 | Zahner |
| 5,087,306 | A | | 2/1992 | Cheung |
| 5,131,614 | A | | 7/1992 | Garcia |
| 5,207,746 | A | | 5/1993 | Jones |
| D338,195 | S | | 8/1993 | Sugarman |
| RE34,366 | E | | 9/1993 | Instance |
| 5,248,164 | A | | 9/1993 | Lepretre |
| 5,279,019 | A | | 1/1994 | Knickle |
| 5,322,724 | A | | 6/1994 | Levens |
| 5,348,781 | A | | 9/1994 | Koblella |
| 5,367,752 | A | | 11/1994 | Petty |
| 5,388,739 | A | | 2/1995 | Gargan |
| 5,467,897 | A | | 11/1995 | Williams |
| 5,531,696 | A | | 7/1996 | Menes |
| 5,595,797 | A | | 1/1997 | Miller |
| 5,617,656 | A | | 4/1997 | Ludlow |
| D385,581 | S | | 10/1997 | Linz |
| D386,211 | S | | 11/1997 | Taparauskas |
| 5,683,194 | A | | 11/1997 | Emmel |
| 5,697,177 | A | | 12/1997 | Ludlow |
| 5,700,537 | A | | 12/1997 | Instance |
| 5,713,467 | A | | 2/1998 | Kao |
| 5,732,495 | A | | 3/1998 | Lowe |
| 5,733,652 | A | | 3/1998 | Stowman |
| 5,778,583 | A | | 7/1998 | Larsen |
| 5,866,219 | A | | 2/1999 | McClure |
| 5,878,520 | A | | 3/1999 | Milbrandt |
| 5,900,307 | A | | 5/1999 | Barcikowski |
| 5,913,619 | A | | 6/1999 | Lowe |
| 5,970,585 | A | * | 10/1999 | Scholey ..... A44B 11/006 2/452 |
| 6,024,225 | A | | 2/2000 | Van der Donk |
| 6,058,639 | A | | 5/2000 | Tinklenberg |
| 6,076,669 | A | | 6/2000 | Ling |
| 6,116,653 | A | | 9/2000 | Oberholzer |
| 6,138,327 | A | * | 10/2000 | Powell ..... B29C 45/14467 24/16 PB |
| 6,146,731 | A | | 11/2000 | Tanoto |
| 6,270,834 | B1 | | 8/2001 | Burrows |
| 6,271,631 | B1 | | 8/2001 | Burrows |
| 6,279,255 | B1 | | 8/2001 | Larsen |
| 6,355,403 | B1 | | 3/2002 | Bourdelais |
| 6,378,700 | B1 | | 4/2002 | Tong |
| 6,381,890 | B1 | | 5/2002 | Sjostedt |
| 6,413,122 | B2 | | 7/2002 | Fujioka |
| 6,449,886 | B1 | | 9/2002 | Gray |
| 6,481,070 | B2 | * | 11/2002 | Caeran ..... A43C 11/148 24/16 PB |
| 6,588,074 | B2 | | 7/2003 | Galkiewicz |
| D494,066 | S | | 8/2004 | Liu |
| D501,892 | S | | 2/2005 | Perry |
| 6,991,261 | B2 | | 1/2006 | Dronzek |
| D532,049 | S | | 11/2006 | Ludlow |
| 7,281,345 | B2 | | 10/2007 | Ludlow |
| 7,418,987 | B2 | | 9/2008 | Duffy |
| 7,836,622 | B1 | | 11/2010 | King |
| 7,941,953 | B2 | | 5/2011 | Ludlow |
| 8,011,127 | B2 | | 9/2011 | Ludlow |
| D670,914 | S | | 11/2012 | Price |
| D723,621 | S | | 3/2015 | Heinrichs |
| D762,985 | S | | 8/2016 | Schiller |
| 2003/0096076 | A1 | | 5/2003 | Allison |
| 2003/0150919 | A1 | | 8/2003 | Blank |
| 2005/0115028 | A1 | | 6/2005 | Cheung |
| 2005/0138854 | A1 | | 6/2005 | Simmons |
| 2005/0166439 | A1 | | 8/2005 | Ludlow |
| 2005/0173073 | A1 | | 8/2005 | Chernoff |
| 2005/0255277 | A1 | | 11/2005 | Syron |
| 2006/0086028 | A1 | | 4/2006 | Vaughan |
| 2006/0147668 | A1 | | 7/2006 | Hirose |
| 2006/0272185 | A1 | | 12/2006 | Malama |
| 2008/0005948 | A1 | | 1/2008 | Ludlow |
| 2009/0188144 | A1 | | 7/2009 | Ludlow |
| 2010/0139133 | A1 | | 6/2010 | Adams |
| 2012/0153109 | A1 | | 6/2012 | Milbrandt |
| 2012/0244325 | A1 | | 9/2012 | Maltas |
| 2013/0059107 | A1 | | 3/2013 | Ludlow |
| 2015/0239615 | A1 | | 8/2015 | O'Donnell |

FOREIGN PATENT DOCUMENTS

| | | | |
|---|---|---|---|
| GB | 2255958 | A | 11/1992 |
| GB | 2382810 | A | 6/2003 |
| GB | 2405854 | A | 3/2005 |
| NL | 1016806 | C1 | 6/2002 |
| WO | 9824086 | A1 | 6/1998 |
| WO | 2007084119 | A1 | 7/2007 |

* cited by examiner

BUNDLING ARTICLE WITH ELASTIC LOOP AND COOPERATING TAG

CROSS-REFERENCE TO RELATED APPLICATION

This application claims the benefit of priority from U.S. Provisional Patent Application No. 62/359,364, filed Jul. 7, 2016, which is hereby incorporated by reference.

BACKGROUND

The prior art is replete with descriptions of bundling products using bands about the products. Sometimes the heretofore known bands have elastic sections united to non-elastic sections, and sometimes they are endless elastic bands commonly called rubber bands.

For example, U.S. Pat. No. 2,516,292 (Bennett) teaches a preformed labeling band of elastic and non-elastic sections for holding bananas constantly under tension as they shrink. The ends of the elastic and non-elastic sections of the band are overlapped and adhesively or otherwise bonded together. U.S. Pat. No. 5,733,652 (Stowman et al.) discusses banding of merchandise by a technique involving in situ bonding of the ends of a strip of elastic material with or without an interposed separate strip of material that is not necessarily elastic. In situ bonding, however, involves carrying bonding equipment to the site where banding of merchandise is to be done (e.g., for bonds formed by heat sealing) or involves removing and disposing of a release liner at the site of banding (e.g., for bonds formed by using liner-protected contact or pressure-sensitive adhesive layers). Neither approach is ideal for bundling items. Also, when either a preformed band of bonded sections or an in situ formed band of bonded sections is stretched about merchandise, it exerts a compressive force on the merchandise. Relatively strong bonds are needed to prevent bond separation under such circumstances since the bonds are in the line of stretching and are subjected to the tension of stretching during use.

Another suitable application for a bundling article involves securing medical hoses to drapes that are used on a patient in surgery. Often in the surgery area, compressed air hoses, communication cables and other support hoses are present. Before surgery starts, the hoses and cables are typically secured to a medical drape arranged around the patient as to not fall to the floor or interfere with the surgical team's operations. Currently this is accomplished with adhesive tapes and/or straps with hook-and-loop fasteners. For this use, a bundling article desirably is adjustable to hold various numbers and sizes of hoses and cables. Typical bundle sizes range from about ⅛" diameter for a single intravenous hose to bundles including one or more of a robotic communication cable of 1" diameter with several smaller hoses varying from ⅛" to ½" diameter.

SUMMARY

In one aspect, a bundling article includes a stretchable portion and a tag portion. The stretchable portion includes a fastening opening having a first width. The tag portion overlaps the stretchable portion at an overlap area, wherein the stretchable portion and the tag portion are bonded together at the overlap area. The tag portion includes a notch, the notch including two opposed shoulders separated by a second width. The second width is substantially equal to or greater than the first width.

This disclosure, in its various combinations, either in apparatus or method form, may also be characterized by the following listing of items:

1. A bundling article including:
   - a stretchable portion including a fastening opening having a first width; and
   - a tag portion overlapping the stretchable portion at an overlap area, wherein the stretchable portion and the tag portion are bonded together at the overlap area, and the tag portion including a notch, the notch including two opposed shoulders separated by a second width, wherein the second width is substantially equal to or greater than the first width.
2. The bundling article of item 1, wherein each shoulder terminates at a point.
3. The bundling article of any of items 1-2, further including an adhesive layer.
4. The bundling article of item 3, wherein the adhesive layer is located on the tag portion.
5. The bundling article of item 4, wherein the adhesive layer is located on a surface of the tag portion that is between the overlap area and the notch.
6. The bundling article of any of items 1-5, wherein the fastening opening is defined by a loop of stretchable material, and wherein the stretchable portion further includes a finger grip extending from the loop in a direction away from the overlap area.
7. The bundling article of any of items 1-6, wherein the tag portion includes an outer perimeter, and wherein the notch is located on the outer perimeter.
8. The bundling article of item 7, wherein the outer perimeter includes two opposed side edges, and wherein each of the two opposed shoulders is located on one of the two opposed side edges.
9. The bundling article of any of items 7-8, further including a round end tab located on an end of the tag portion opposite the overlap area.
10. The bundling article of any of items 7-9, wherein the notch is one of a plurality of notches located on the outer perimeter.
11. The bundling article of any of items 1-6, wherein the tag portion includes an outer perimeter, and wherein the notch does not reach the outer perimeter.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals and primed (designated with an apostrophe) reference numbers throughout the several views. It is contemplated that all descriptions are applicable to like and analogous structures throughout the several embodiments.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, etc., are used, it is to be understood that they are used only for ease of understanding the description. It is contemplated that structures may be oriented otherwise.

DETAILED DESCRIPTION

Figure 1:
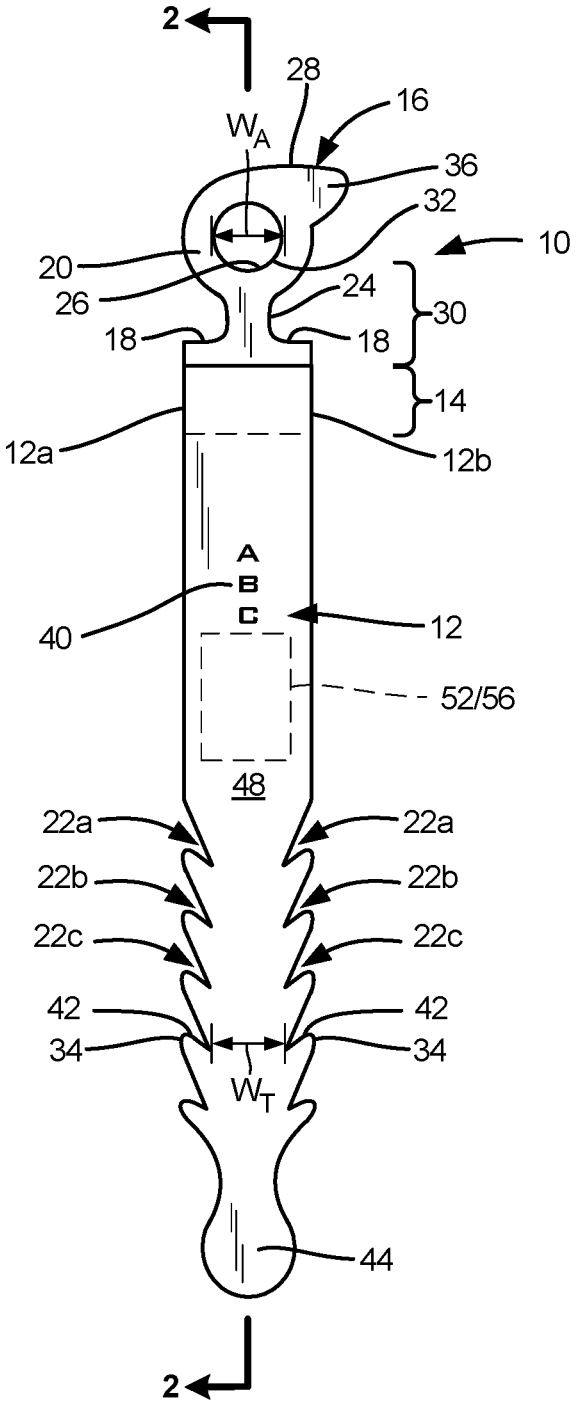
FIG. 1 is a front view of a first exemplary embodiment of a bundling article.
Figure 5:
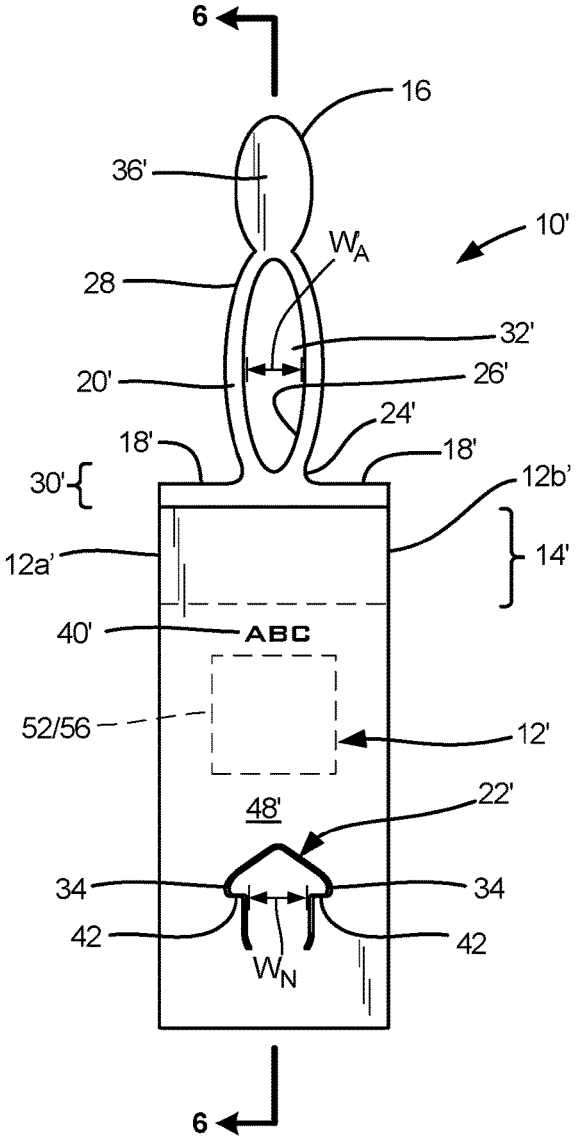
FIG. 5 is a front view of a second exemplary embodiment of a bundling article.

The illustrated embodiments of exemplary bundling articles 10, 10' show just two variations accordingly to the present disclosure. It is contemplated that many other changes in form and configuration are possible that fall within the scope of the present descriptions. Referring to FIGS. 1 and 5, bundling article 10, 10' has tag 12, 12' flatly conjoined along a unifying flat bond zone 14, 14' with flexible elastic layer 16, 16' that extends away from the tag 12, 12' and is configured with an elastic fastening loop 20, 20'. The entire article 10, 10' is sheet-like in the sense that tags 12, 12' are sheets of a flat nature and elastic layers 16, 16' are also sheets of flat character (although they may be drapeable and floppy and thus not always displayed in flat form). The tag 12, 12' and elastic layer 16, 16' are flatly conjoined so that the sheet character of each extends onto the sheet character of the other, giving a total unitary sheet-like character to the entire article 10, 10'. Further, the result is a unifying flat bond zone 14, 14' at the coextensive overlap of the tag 12, 12' and elastic layer 16, 16'. In an exemplary embodiment, a width of the tag 12, 12' between its sides 12*a*, 12*b* and 12*a*', 12*b*' in the bond zone 14, 14' and the width of the elastic layer 16, 16' in the bond zone 14, 14' are equal or approximately equal.

The flexible elastic fastening loop 20, 20' has an inner perimeter edge 26, 26' that defines the boundary of an aperture 32, 32' through the loop 20, 20'. The outer boundary or edge 28 may surround a finger grip 36, 36' at a distal end of elastic layer 16, 16', remote from bond zone 14, 14'. While aperture 32 is illustrated as circular and aperture 32' is illustrated as substantially oval, it is contemplated that an aperture through a fastening loop can have any of a variety of closed shapes, including regular and irregular polygons and holes having outlines with segments that are curved, straight, and combinations thereof.

In the exemplary embodiments, aperture 32, 32' is spaced from bond zone 14, 14'. In the illustrated embodiments, bond zone 14, 14' has a generally rectangular configuration, due to the shapes of the overlapping portions of tag 12, 12' and elastic layer 16, 16'. However, it is contemplated that such overlapping portions may have any shape, including those formed with irregular edges.

Dispersion zone 30, 30' is defined between aperture 32, 32' and bond zone 14, 14'. Its function is to disperse at least some of the in-line tension forces created as a result of the stretching of elastic loop 22, 22' to allow the passage therethrough of a portion of tag 12, 12', as discussed below. Those tension forces are called "in-line" tension forces because they are in the line of stretching of the loop 20, 20'. Dissipation of such tension forces is desirable at least to some extent so as to reduce (or sometimes even substantially eliminate) the stress of that tension passing into the bond zone 14, 14'. In an exemplary embodiment, a length dimension of dispersion zone 30, 30' between aperture 32, 32' and bond zone 14, 14' is at least about 50 mils and is more typically about ⅛ inch (or 125 mils) or greater.

In exemplary embodiments, lateral shoulders 18, 18' are located on both sides of neck 24, 24' and assist in relieving or dissipating tensioning forces within a stretched loop 20, 20' from being transmitted into the bond zone 14, 14' at its lateral edges (coincident with tag edges 12*a*, 12*b* and 12*a*', 12*b*'). Thus, a relatively weaker unification between the tag 12, 12' and the elastic layer 16, 16' at the bond zone 14, 14' is sufficient as compared to the strength of unification in a bond zone needed between a strip of elastic material and any other material that forms a band about merchandise (where the bond zone between parts of the band is continually subjected to the tension of a band stretched about merchandise). However, other embodiments of a bundling article may not have a narrowed neck region or lateral shoulders.

In an exemplary embodiment, tag 12, 12' has a width between side edges 12*a*, 12*b* or 12*a*', 12*b*' between about 0.25 inch and about 1 inch. In an exemplary embodiment, tag 12, 12' has a length (substantially orthogonal to its width) between about 1 inch and about 5 inches. In an exemplary embodiment, elastic layer 16, 16' has a width that is substantially similar to the width of tag 12, 12'. However, it can be seen in FIG. 1 that a distal end of elastic layer 16 including finger grip portion 36 is wider than the width of tag 12. Moreover, as shown in FIG. 5, a distal end of elastic layer 16' including finger grip portion 36' is narrower than the width of tag 12'. In exemplary embodiments, a length of elastic layer 16' extending away from bond zone 14, 14' is between about 0.5 inch and about 4 or 5 inches. Tag 12, 12' and elastic layer 16, 16' overlap each other in bond zone 14, 14'. The length of bond zone overlap B, B' (labeled in FIGS. 2 and 6) is generally about 3/16 or ¼ inch or even ⅜ inch, but is usually not over about ½ inch.

Rectangular style tags 12, 12' are especially practical for economy purposes, but tags may indeed take different forms such as octagonal shapes, triangular shapes, rhomboidal shapes, circular shapes, oval shapes, and irregular shapes. As shown in FIGS. 3, 4, 7 and 8, a thickness dimension, material composition, and structural features of tags 12, 12' are selected to allow the bundling articles 10, 10' to be wrapped around products 38, wherein loop 20, 20' is secured around a notch 22, 22' of tag 12, 12'. Tag 12 is typically in the form of a continuous panel of sheet material, while tag 12' has cuts therethrough. Tags 12, 12' may also have other holes or openings. Suitable sheet material for tag 12, 12' is preferably relatively thin, generally not over about 15 or 40 mils (i.e., 0.015 or 0.040 inch) in thickness. The tag material should be flexible and pliable but is preferably not elastic, and is therefore dimensionally stable, for most applications.

In exemplary embodiments, the sheet material for the tag 12, 12' is also sufficiently water resistant to not disintegrate and not significantly pucker or wrinkle or otherwise disfigure or deform when placed in water. In some embodiments, indicia 40, 40' are provided on front surface 48, 48' and/or back surface 50, 50' of tag 12, 12'. Such indicia may be printed, embossed, or otherwise provided. In exemplary embodiments, indicia 40, 40' are sufficiently water resistant to avoid disintegration or destruction when repeatedly subjected to water and washing operations (as is common for produce displays in supermarkets). The sheet material for the tag 12, 12' also should be somewhat tough in the sense of being sufficiently tear resistant to deter damage to it during banding, storage, transport and display, or by staff or customer handling.

Especially suitable materials for forming the tag sheet material include non-woven fabrics, non-woven films, paper, polystyrenic thermoplastics, polyolefinic thermoplastics, polyesters, and others that exhibit the properties discussed (which can vary depending on how the bundling article is to be use). Suitable materials include thermoplastic materials and polymers of styrene, ethylene, propylene, as well as a variety of other monomers and mixtures of monomers (e.g., to make co-polymers and ter-polymers, etc.). Any of a variety of commercially available inks compatible with, or accepted on, a tag sheet and retained thereon, and in any desired color, may be used to print indicia 40, 40' on tag 12, 12' if desired. Moreover, if it should be desired to use water-soluble ink markings, a thin film of water-insoluble plastic may be applied over the ink to enhance water resistance.

High-impact polystyrene sheets are especially useful as tag material. To improve impact properties, a styrene-butadiene-styrene impact modifier can be useful in amounts up to about 40 percent of the weight of the polystyrene itself. Tags 12, 12' of such material are highly dimensionally stable against stretching and have desired flexibility balanced by a slight stiffness that contributes to ease of handing during manufacture and use. Such tags 12, 12' also can be reliably printed, especially when first subjected to a surface treatment such as, for example, a corona treatment such as available from Pillar Technologies of Hartland, Wis., a division of Illinois Tool Works.

The elastic layer 16, 16' will generally have a layer thickness that is greater than the thickness of the tag 12, 12' by at least about 20 percent up to about 600 percent. Typically, a thickness of the elastic layer 16, 16' that extends away from the tag 12, 12' will be about twice the thickness of the tag 12, 12' but usually will not exceed about 30 or 35 mils when the tag thickness lies in what is expected to be the popular range of about 5 to about 10 mils. It is conceivable, of course, to form bundling article 10, 10' with a tag thickness and elastic layer thickness that are approximately equal (especially where one employs fusion bonding for the bond zone 14, 14' between the tag 12, 12' and elastic layer 16, 16'). It is also conceivable to use elastic layer thicknesses up to but not usually greater than 100 mils.

Exemplary materials for forming the elastic layer 16, 16' including the elastic loop 20, 20' are rubber-like in character in that they should bounce back from a stretched condition relatively quickly, but absolutely instantaneous retraction or bounce back to an original relaxed condition after stretching is not always critical for functional elastic performance.

A variety of elastomers giving satisfactory elasticity and stretchability include thermoplastic elastomers that are at least heat softenable and even heat meltable to a flowable or moldable state. One of the more common families of thermoplastic elastomers include styrenic block co-polymers. This family includes styrene-butadiene styrene and styrene-ethylene-butylene styrene. Another family of useful thermoplastic elastomers include olefinic elastomers, especially those based on ethylene and polypropylene (e.g., where interposed different monomer blocks are not used but blocks of different tacticity—atactic and isotactic—are created by using metallocene catalysis polymerization). Yet another family of thermoplastic elastomers include polyvinyl chloride-based elastomers. Still other families of thermoplastic elastomers can be based on urethanes, nylon, and silicon, for example.

Selection of an elastomer material may take into account factors such as cost and bonding compatibility with a material of tag 12, 12'. Generally, similar materials tend to bond together (as by polymer bonding) better than dissimilar materials; and materials of like polarity usually bond better than materials of unlike polarity. Thus, tag material selection can be made from polymers in the same family as the elastomer, such as those including at least some monomers related to, or the same as those present in, the elastomer chosen for the elastic layer 16, 16'. Surface treatments such as corona treatments also help to improve bonding. Still further, compatibilizers that adjust the polarity of material can be used to improve bonding. Additional information is described in U.S. Pat. No. 8,635,795 to Ludlow et al.; U.S. Pat. No. 9,105,205 to Ludlow et al.; and U.S. Patent Application Publication No. 2015/0239615 to O'Donnell, et al., all of which are hereby incorporated by reference. A common practice in handling polymeric materials for tag 12, 12' and elastic layer 16, 16' is to add compatible (i.e., readily blendable) ingredients to achieve desired properties such as coloration, opacification, resistance to degradation on exposure to environmental conditions, improved impact properties and adhesion properties, for example.

In an exemplary embodiment, elastic layer 16, 16' is substantially uniform in composition throughout its extent. On the other hand, the tag 12, 12' may be a laminate of different layers, including a possible protective coating over a printed layer, especially a printed layer that is believed to need further protection against smudging or destruction.

Heat welding as by applying heat and pressure on overlapping thermoplastic polymeric materials forming the tag 12, 12' and the elastic substrate 16, 16' can be useful to form the bond therebetween at bond zone 14, 14'. Significant heat at the bond zone 14, 14' of overlapping thermoplastic polymeric materials can also result in complete fusion between the polymer of the tag 12, 12' and the polymer of the elastic layer 16, 16'. Sonic welding is another way to unify the layers and achieve a cohesive bond between compatible parts. Laminating a molten elastomer to a molten (or at least softened) tag material by co-extrusion is another way of forming bond zone 14, 14'. This method can be particularly effective where molecules or parts of molecules of the tag polymer and the molten elastomer substrate material at the bond zone 14, 14' interdiffuse with each other. Bonds can also be formed by interposing an intermediate layer at the bond zone 14, 14' (e.g., a hot melt bonding adhesive) to which both the tag material and the elastic layer material will readily bond because of their compatibility to the intermediate material. Still further, treatment of the surface areas where bonding is to be accomplished can be effective. Even mechanical bonding can be effective, as where the tag material is porous (e.g., paper and the porous polymer product called "Teslin"), and the elastomeric layer is applied in molten condition or at least in a softened condition and pressed into the voids or interstices of the porous tag layer. Any useful bonding technique and structure that joins the tag 12, 12' with the elastic layer 16, 16' in a manner forming a unifying flat bond zone 14, 14' that can withstand delamination in expected use is suitable.

In an exemplary embodiment, bundling article 10, 10' has a high-impact polystyrene tag 12, 12' and an elastic layer 16, 16' formed using a styrene-butadiene-styrene (SBS) block co-polymer available from GLS Corporation under the tradename "Kraton D-2104." This co-polymer has several beneficial features such as high clarity, good dimensional stability, food contact acceptability, relatively high strength, low viscosity, ease of coloring, and high elongation. To improve its adhesion to a styrenic tag 12, 12', an optional addition of up to 10 percent by weight of polystyrene (based on the weight of the elastomer in the composition) may be blended in the elastomer composition for elastic layer 16, 16'. The composition can easily be colored, as for example by using polystyrene base color concentrates from Clariant (of Minneapolis, Minn.) or by using polyethylene base color concentrates from Ampacet (of Tarrytown, N.Y.) at concentrations of up to about 5 percent or more of the weight of the base styrene-butadiene-styrene block co-polymer.

Those skilled in the art will recognize that any suitable process for the manufacture of the new bundling articles of the disclosure can be employed. Batch processing is useful for extremely limited production runs. Conveyor processing with indexing from station to station for specific operations can be useful, especially for uniquely designed or shaped tags or elastic substrates.

Web-based processing is especially suitable from the standpoint of economy. For example, a high impact polystyrene web is fed simultaneously with molten elastomer (e.g., a thermoplastic elastomer such as styrenic block copolymer) through the nip of chill rollers. The molten elastomer is applied to extend with a sufficient overlap onto the lateral edges of the web to create the bond zone 14, 14' as well as to extend sufficiently laterally outward from the bond zone (i.e, lateral edge of web) to provide material for dispersion zone 30, 30' and elastic loop 20, 20'. The temperature of the chill rollers is adjusted to cool the molten elastomer to an at least partially cured state while simultaneously applying pressure (up to about 500 psi) to form elastomer layer 16, 16' at the desired thickness and also to bond tags 12, 12' to the elastomer layer 16, 16' at bond zone 14, 14'. Lateral and longitudinal positioning of the composite web (of tag and elastomer) is controlled as it is passed in proper registration between die cutting and anvil rollers to cut and score individual article profiles that are then severed into individual articles 10, 10'.

Figure 3:
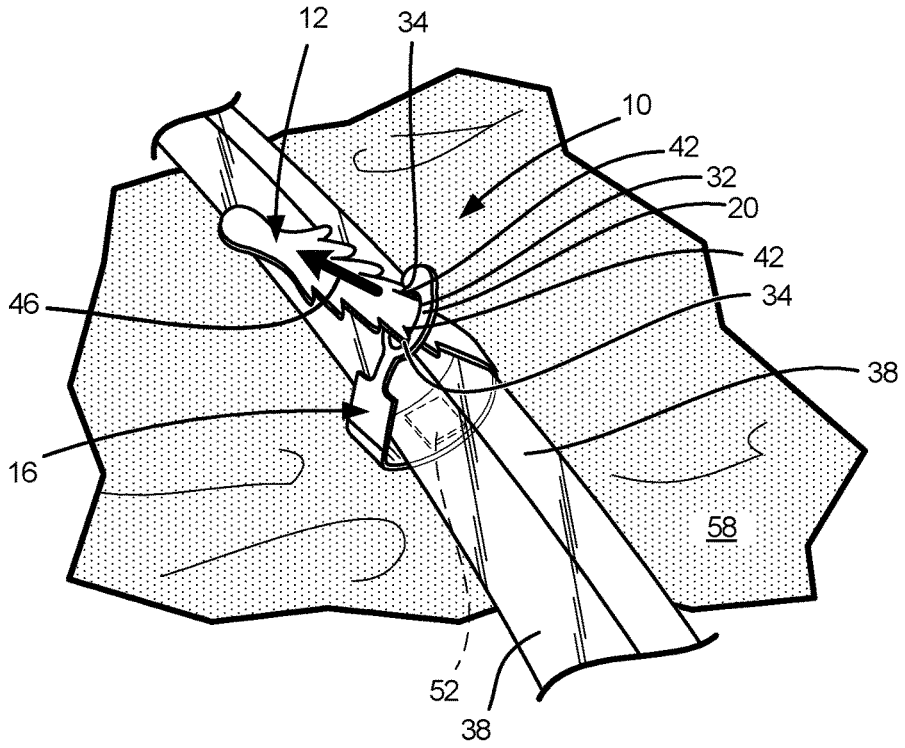
FIG. 3 is a perspective view of the bundling article of FIGS. 1 and 2 applied to a surface and being applied to a bundle of products.
Figure 4:
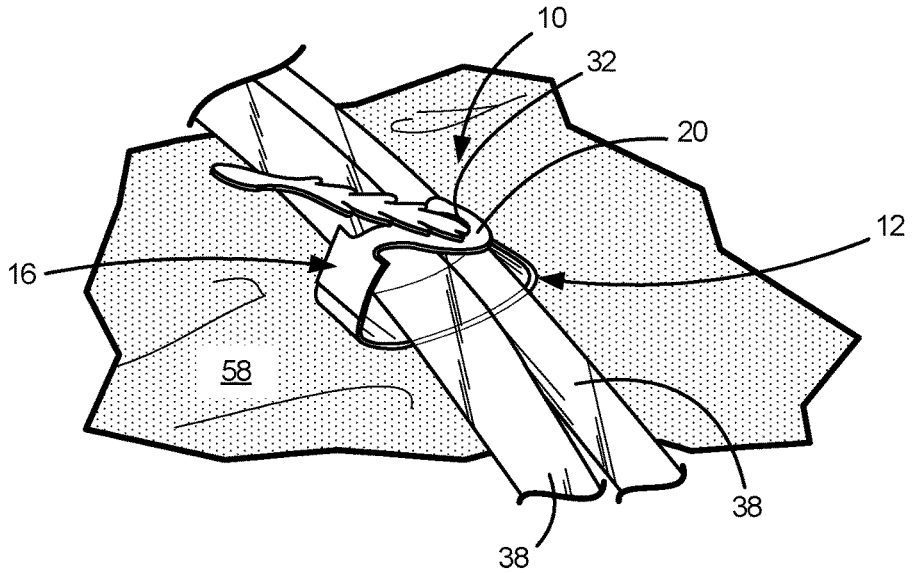
FIG. 4 is a perspective view of the bundle of products of FIG. 3 held together by the bundling article of FIGS. 1 and 2 and thereby secured to the surface.

FIG. 3 is a perspective view of bundling article 10 applied to a surface of medical drape 58 via adhesive layer 52. Further, bundling article 10 is looped around a bundle of products 38, such as tubing. FIG. 4 is a perspective view of the bundle of products 38 held together by the bundling article 10 and thereby secured to drape 58. Referring to FIG. 1, tag 12 includes a plurality of notches or serrations 22 on side edges 12*a*, 12*b*. Each of notches 22*a*, 22*b*, 22*c*, etc. in an exemplary embodiment includes two opposed points 34 and corresponding shoulders 42. In an exemplary embodiment, an end of tag 12 includes round end tab 44.

As shown in FIG. 3, in an exemplary method of use, a user adheres bundling article 10 to a surface of medical drape 58 via adhesive layer 52. The user wraps bundling article 10 around the bundle of products 38 and pulls end tab 44 through aperture 32 in direction 46. The user continues to pull end tag 44 in direction 46 to an extent that opposing shoulders 42 of one of the notches 22*a*, 22*b*, 22*c*, etc. engage sides of loop 20 to prevent tag 12 from pulling out of loop 20 in an direction opposite direction 46. It can be seen that several notches 22*a*, 22*b*, 22*c*, etc. are provided, with cooperating shoulders 42 on both side edges 12*a*, 12*b* (on an outer perimeter) of tag 12 to allow for adjustability in the size of the loop of article 10 wrapped about the bundle of products 38. In an exemplary embodiment, a width $W_T$ of tag 12 between opposed shoulders 42 of any of notches 22*a*, 22*b*, 22*c*, etc. is slightly greater than a width $W_A$ of aperture 32. Accordingly, tag 12 is slightly bent along its width, and/or loop 20 is slightly stretched about aperture 32; both of these mechanisms enhance the connection between tag 12 within aperture 32 of elastic layer 16 in the looped configuration shown in FIGS. 3 and 4. However, because of the flexibility of the materials of bundling article 10, it can be appreciated that a user may undo the looped configuration by further bending tag 12 and/or further stretching loop 20 to allow points 34 of notches 22 to pass back through aperture 20 in the direction opposite direction 46. Such looping and unlooping of article 10 may be facilitated by the user's finger placement on finger grip 36 of elastic layer 16.

Figure 7:
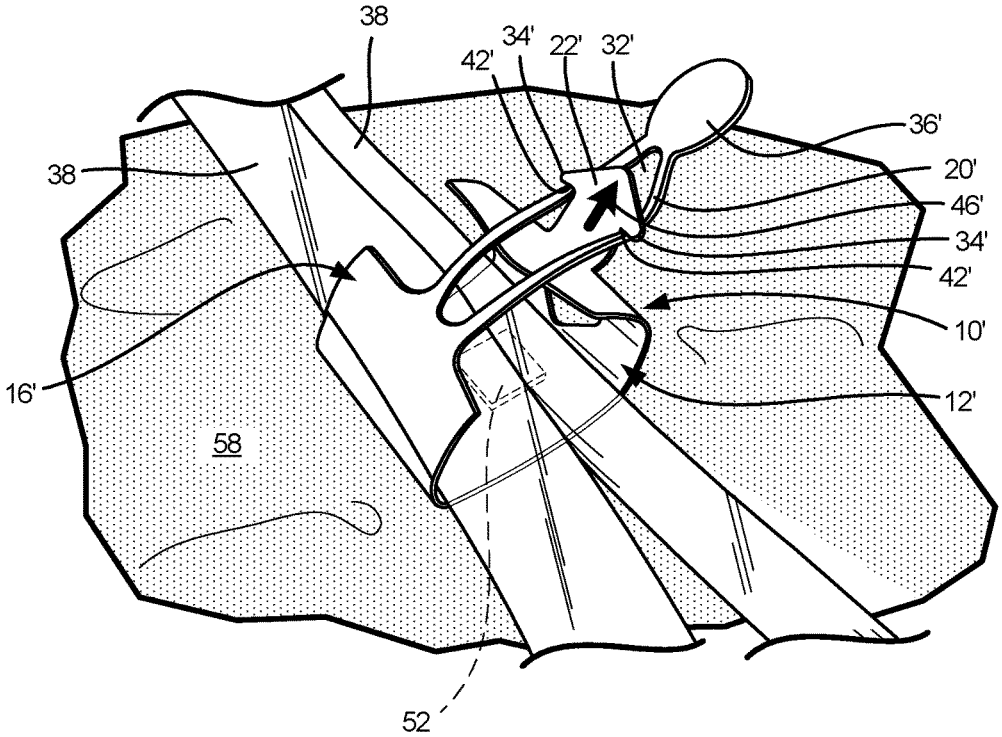
FIG. 7 is a perspective view of the bundling article of FIGS. 5 and 6 applied to a surface and being applied to a bundle of products.
Figure 8:
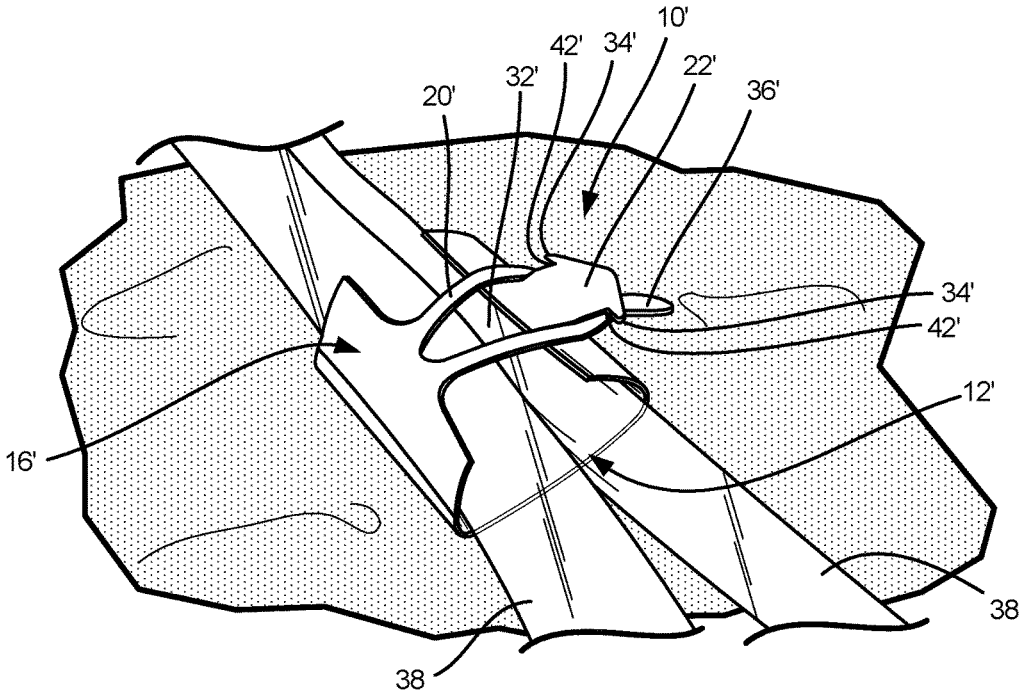
FIG. 8 is a perspective view of the bundle of products of FIG. 7 held together by the bundling article of FIGS. 5 and 6 and thereby secured to the surface.

FIG. 7 is a perspective view of bundling article 10' applied to a surface of medical drape 58 via adhesive layer 52. Further, bundling article 10' is looped around a bundle of products 38, such as tubing. FIG. 8 is a perspective view of the bundle of products 38 held together by the bundling article 10' and thereby secured to drape 58. Referring to FIG. 5, tag 12' includes internal cuts to form an arrow-shaped notch 22' that does not reach tag side edges 12*a*' and 12*b*' or any edge of the tag perimeter. An exemplary notch 22' includes two opposed points 34' and shoulders 42'.

As shown in FIG. 7, in an exemplary method of use, a user adheres bundling article 10' to a surface of medical drape 58 via adhesive layer 52. The user wraps bundling article 10' around the bundle of products 38 and pulls notch 22' through aperture 32' in direction 46' to an extent that opposing shoulders 42' of notch 22' engage sides of loop 20' to prevent notch 22' from pulling out of loop 20' in an direction opposite direction 46'. It can be seen that a length of elastic loop 20' and its stretchability allow for adjustability in the size of the loop of article 10' wrapped about the bundle of products 38'. In an exemplary embodiment, a width $W_N$ of notch 22' between opposed shoulders 42' is slightly greater than a width $W'_A$ of aperture 32'. Accordingly, notch 22' is slightly bent along its width, and/or loop 20' is slightly stretched about aperture 32'; both of these mechanisms enhance the connection between notch 22' within aperture 32' of elastic layer 16' in the looped configuration shown in FIGS. 7 and 8. However, because of the flexibility of the materials of bundling article 10', it can be appreciated that a user may undo the looped configuration by further bending notch 22' and/or further stretching loop 20' to allow points 34' of notch 22' to pass back through aperture 20' in the direction opposite direction 46'. Such looping and unlooping of article 10' may be facilitated by the user's finger placement on finger grip portion 36' of elastic layer 16'.

Figure 2:
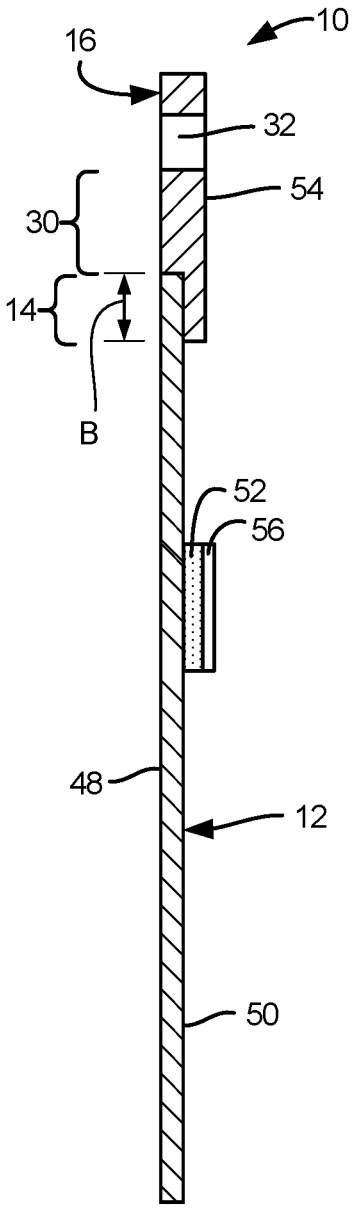
FIG. 2 is a cross-sectional view taken on line 2-2 of FIG. 1.
Figure 6:
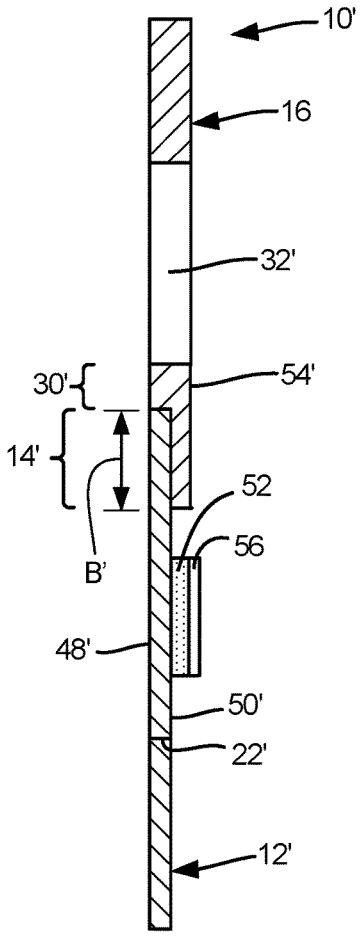
FIG. 6 is a cross-sectional view taken on line 6-6 of FIG. 5.

As show in FIGS. 2 and 6, article 10, 10' optionally includes adhesive layer 52, located in an exemplary embodiment on one or more portions of front surface 48, 48' or back surface 50, 50' of tag 12, 12'. Adhesive layer 52 may be used to adhere article 10, 10' to product 38 and/or another item, such as drape 58. Accordingly, article 10, 10' may be retained on product 38 even if not looped around product 38. In the use of any embodiments of bundling article 10, 10', the article 10, 10' can be looped around products 38 before the assembly of article 10, 10' and products 38 is secured to another surface via adhesive layer 52. Moreover, while an adhesive layer is described, other attachments means can also be used, such as other chemical or mechanical fasteners.

Article 10, 10' allows for ease of application and removal of the bundled products 38 (e.g., hose and cables), which is important because some surgical procedures require the hoses to be moved and re-secured several times during one use of the drape 58. Article 10, 10' is desirably formed as a unitary piece, which is easier for a user to handle as compared to a two (or multiple) piece assembly that requires the user to precisely align cooperating pieces on the drape 58 in order for the features to work properly.

In an exemplary method of use, before application of article 10, 10' to product 38, adhesive layer 52 may be protected by a removable release liner 56. Examples of suitable adhesives include pressure sensitive adhesives (PSAs) (e.g. hot-melt PSAs), such as those based on acrylic monomers and polymers (e.g., bio-based acrylates), block copolymer rubber adhesives, silicone rubber adhesives, and the like, which may optionally include one or more additional tackifying resins. Liner 56 is configured to release from adhesive layer 52 so that adhesive layer 52 remains on tag 12, 12'. Liner 56 may be fabricated from a paper and/or polymeric web (e.g., a polyolefin and/or polyethylene terephthalate web) coated with one or more release agents (e.g., a silicone release coating). In an exemplary embodiment, adhesive layer 52 and its corresponding liner 56 are applied to back surface 50, 50' of tag 12, 12' between the overlap area of bond zone 14, 14' and notch 22, 22'. Such a placement minimizes the interference of adhesive layer 52 with the stretching characteristics of elastic layer 16, 16' and minimizes interference with the cooperative operation of notches 22, 22' and corresponding elastic loops 20, 20'.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa.

The invention claimed is:

1. A bundling article including:

a stretchable portion including a fastening opening having a first width; and a tag portion overlapping the stretchable portion at an overlap area, wherein the stretchable portion and the tag portion are bonded together at the overlap area, and the tag portion including a notch, the notch including two opposed shoulders separated by a second width, wherein the second width is substantially equal to or greater than the first width.

2. The bundling article of claim 1, wherein each shoulder terminates at a point.

3. The bundling article of claim 1, further including an adhesive layer.

4. The bundling article of claim 3, wherein the adhesive layer is located on the tag portion.

5. The bundling article of claim 4, wherein the adhesive layer is located on a surface of the tag portion that is between the overlap area and the notch.

6. The bundling article of claim 1, wherein the fastening opening is defined by a loop of stretchable material, and wherein the stretchable portion further includes a finger grip extending from the loop in a direction away from the overlap area.

7. The bundling article of claim 1, wherein the tag portion includes an outer perimeter, and wherein the notch is located on the outer perimeter.

8. The bundling article of claim 7, wherein the outer perimeter includes two opposed side edges, and wherein each of the two opposed shoulders is located on one of the two opposed side edges.

9. The bundling article of claim 7, further including a round end tab located on an end of the tag portion opposite the overlap area.

10. The bundling article of claim 7, wherein the notch is one of a plurality of notches located on the outer perimeter.

11. The bundling article of claim 1, wherein the tag portion includes an outer perimeter, and wherein the notch does not reach the outer perimeter.

* * * * *